US010376029B2

(12) United States Patent
Yu

(10) Patent No.: US 10,376,029 B2
(45) Date of Patent: Aug. 13, 2019

(54) LUGGAGE

(71) Applicant: Thomas Yu, La Palma, CA (US)

(72) Inventor: Thomas Yu, La Palma, CA (US)

(73) Assignee: TRAVELERS CLUB LUGGAGE, INC., La Palma, CA (US)

( * ) Notice: Subject to any disclaimer, the term of this patent is extended or adjusted under 35 U.S.C. 154(b) by 226 days.

(21) Appl. No.: 15/238,541

(22) Filed: Aug. 16, 2016

(65) Prior Publication Data

US 2018/0049524 A1 Feb. 22, 2018

(51) Int. Cl.

| | |
|---|---|
| ***A45C 13/03*** | (2006.01) |
| ***A45C 5/03*** | (2006.01) |
| ***A45C 5/14*** | (2006.01) |
| ***A45C 13/26*** | (2006.01) |
| ***A45C 13/10*** | (2006.01) |
| ***A45C 13/04*** | (2006.01) |

(52) U.S. Cl.

CPC ..... *A45C 5/03* (2013.01); *A45C 5/14* (2013.01); *A45C 13/04* (2013.01); *A45C 13/103* (2013.01); *A45C 13/262* (2013.01); *A45C 2013/267* (2013.01)

(58) Field of Classification Search

CPC ..... A45C 5/14; A45C 13/262; A45C 5/146; A45C 13/385; A45C 3/004

USPC ..... 190/18 A, 100–115, 18 R; 280/37; 206/373, 320, 315.1–315.7

See application file for complete search history.

(56) References Cited

U.S. PATENT DOCUMENTS

| | | | | |
|---|---|---|---|---|
| 4,335,896 | A * | 6/1982 | Koffler | A45C 5/143 16/30 |
| 4,925,021 | A * | 5/1990 | Pulichino, Jr. | A45C 3/001 190/109 |
| 5,762,168 | A * | 6/1998 | Miyoshi | A45C 5/14 190/115 |
| 7,874,408 | B2 * | 1/2011 | Suppancig | A45C 13/262 16/113.1 |
| 8,783,432 | B2 * | 7/2014 | Wang | A45C 5/03 190/115 |
| 9,622,597 | B2 * | 4/2017 | White | A47F 7/24 |
| 9,894,970 | B2 * | 2/2018 | Sheikh | A45C 5/06 |
| 2003/0209396 | A1 * | 11/2003 | Bernbaun | A45C 3/00 190/18 A |
| 2007/0157635 | A1 * | 7/2007 | Ford | F25D 3/08 62/62 |

(Continued)

*Primary Examiner* — Fenn C Mathew
*Assistant Examiner* — Cynthia F Collado
(74) *Attorney, Agent, or Firm* — John K. Park; Park Law Firm

(57) ABSTRACT

A luggage includes first, second, central compartments and a trolly handle. The first compartment has a first lid portion provided on an outer opening portion, two side portions, a top portion, a bottom portion, and an inner opening portion defined by inner edges of the two side portions, the top portion, and the bottom portion. The second compartment has portions similar to the first compartment. The central compartment is provided between the inner opening portions of the first compartment and the second compartment. The trolly handle has two vertical leg portions and a handle portion connected to the two vertical leg portions substantially perpendicular to each of the two vertical leg portions. Each of the two vertical leg portions of the trolly handle is embedded in a corresponding side wall portion of the central compartment.

18 Claims, 14 Drawing Sheets

(56) References Cited

U.S. PATENT DOCUMENTS

| | | | | |
|---|---|---|---|---|
| 2012/0160626 | A1* | 6/2012 | Yang | A45C 5/02<br>190/18 A |
| 2014/0360907 | A1* | 12/2014 | Fan | B62B 3/005<br>206/486 |
| 2018/0049524 | A1* | 2/2018 | Yu | A45C 13/04 |

* cited by examiner

Fig. 9
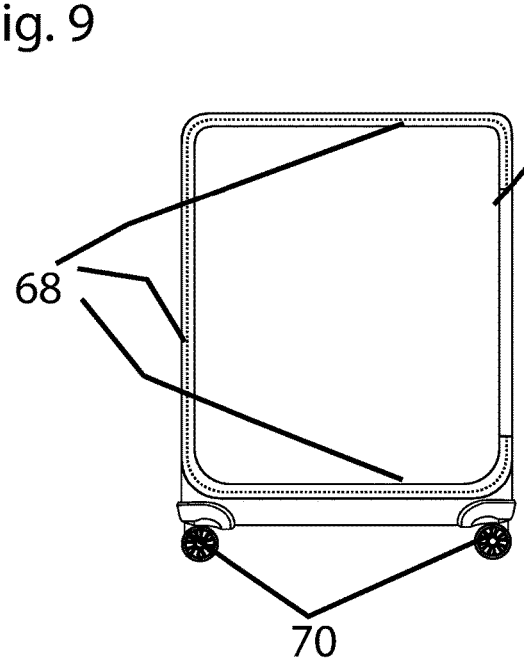
Fig. 10
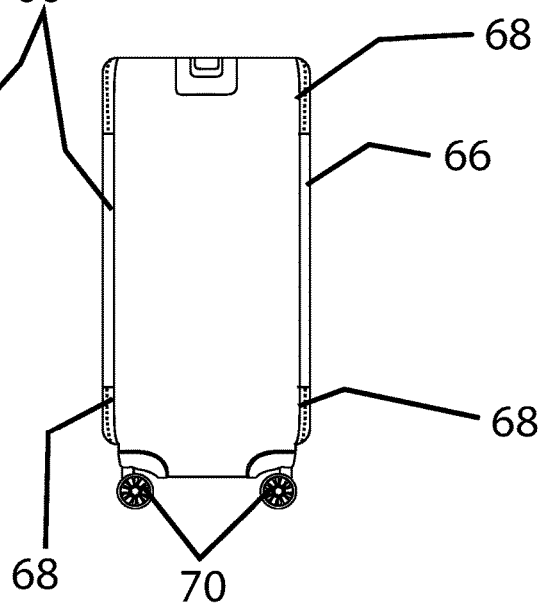
Fig. 11
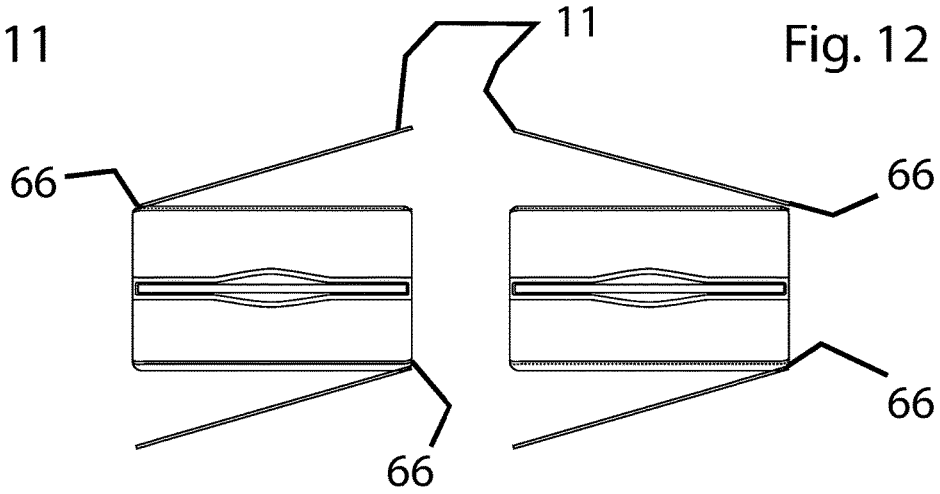
Fig. 12

Fig. 17
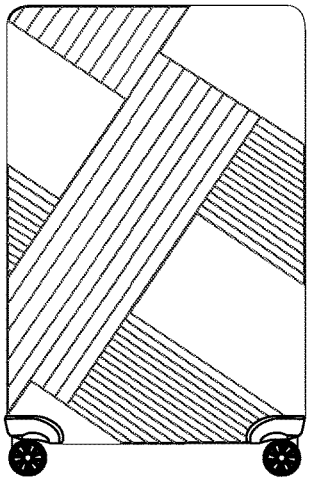
Fig. 18
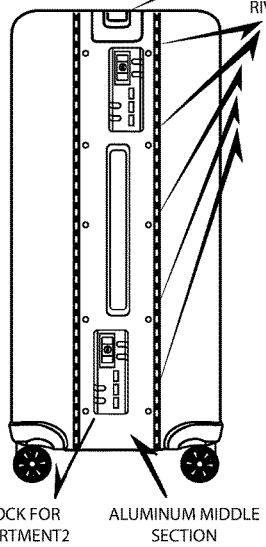
Fig. 19
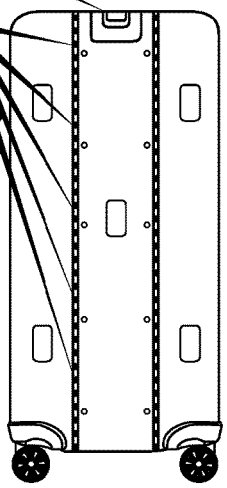
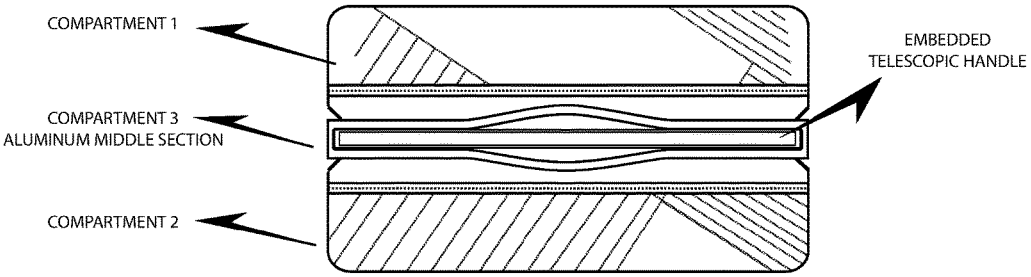
Fig. 20

Fig. 21
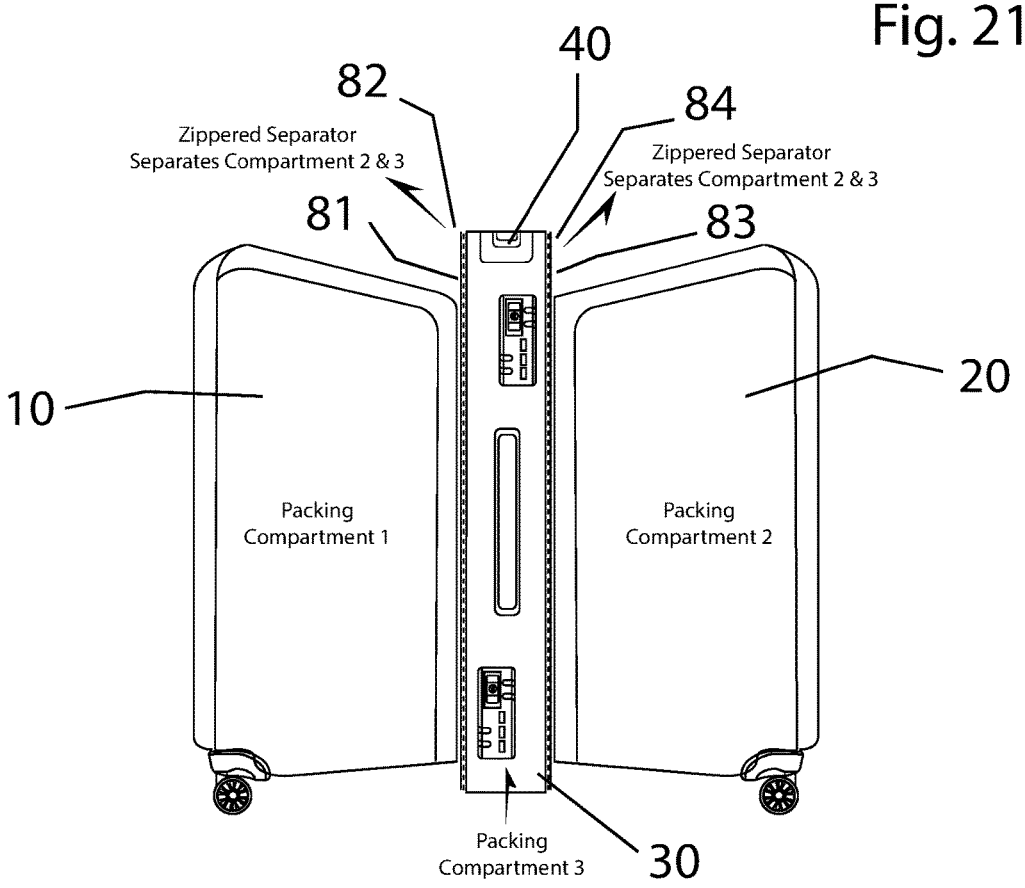
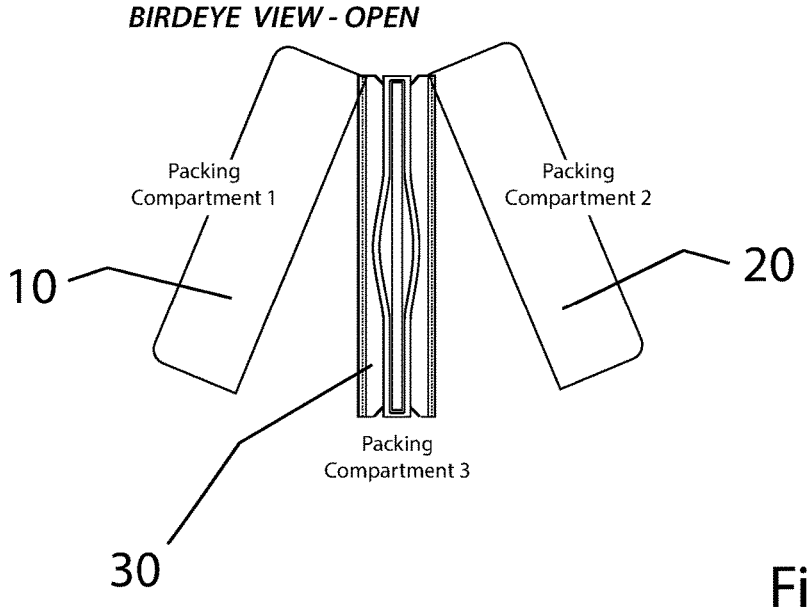
Fig. 22

Fig. 23
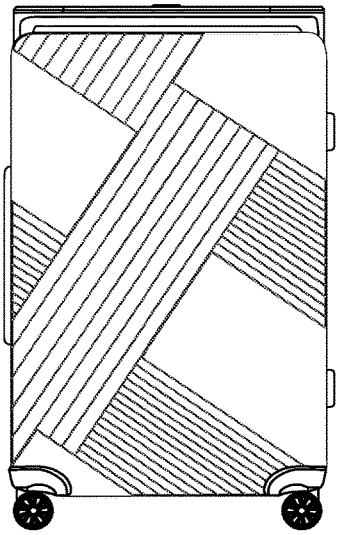
Fig. 24
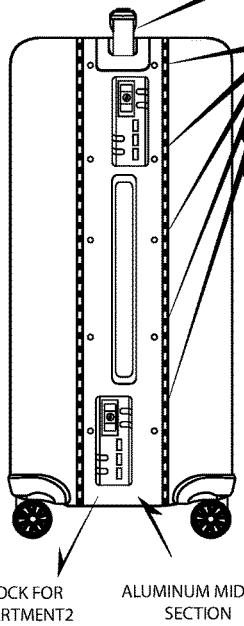
Fig. 25
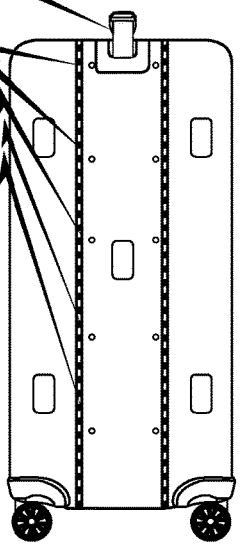
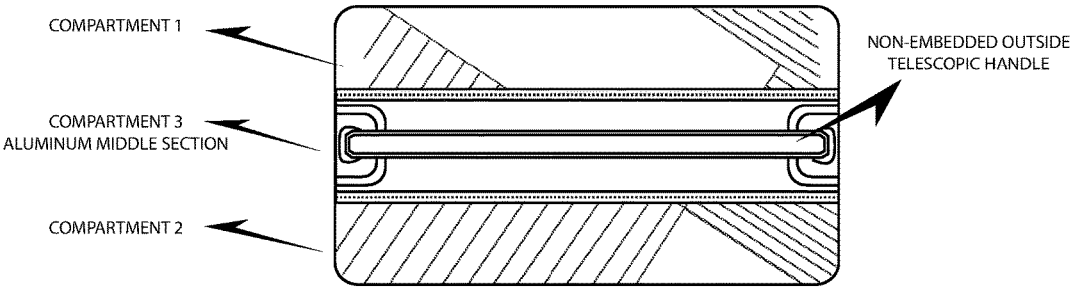
Fig. 26

LUGGAGE

BACKGROUND OF THE INVENTION

The present invention relates to a luggage.

Since the Industrial Revolution, the transportation has been increasing nearly without limit. Such trend seems to peak with the advent of jumbo jet for travelers and tourists.

Tourists do not go anywhere without luggage.

However, it is not a simple problem to solve to provide a perfect luggage, which must be optimized with space and compartments and accessing the compartments.

Therefore, even though luggages with various designs have been provided in prior arts, but there are lots of features to improve in the conventional luggages.

In addition to the compartmentalization of storing space and the accessing points to the compartments, there is another problem to solve: trolly handle.

Accordingly, a need for a luggage has been present for a long time considering the expansive demands in the everyday life. This invention is directed to solve these problems and satisfy the long-felt need.

SUMMARY OF THE INVENTION

The present invention contrives to solve the disadvantages of the prior art.

An aspect of the invention provides a luggage, which comprises a first compartment, a second compartment, a central compartment, and a trolly handle.

The first compartment comprises a first lid portion provided on an outer opening portion, two side portions, a top portion, a bottom portion, and an inner opening portion defined by inner edges of the two side portions, the top portion, and the bottom portion.

The second compartment comprises a second lid portion provided on an outer opening portion, two side portions, a top portion, a bottom portion, and an inner opening portion defined by inner edges of the two side portions, the top portion, and the bottom portion.

The central compartment is provided between the inner opening portions of the first compartment and the second compartment and comprising two side wall portions, a top wall portion, a bottom wall portion, and first and second opening portions.

The trolly handle comprises two vertical leg portions and a handle portion connected to the two vertical leg portions substantially perpendicular to each of the two vertical leg portions.

Each of the two vertical leg portions of the trolly handle is embedded in or protruding on a corresponding side wall portion of the central compartment, so that the luggage is configured to be maneuverable in first and second directions toward the first and second compartments, respectively.

The handle portion of the trolly handle may be connected to each of the two vertical leg portions through telescopic structure provided therethrough.

The top portion of the first compartment, the top portion of the second compartment, and the top wall portion of the central compartment may be integrated into one body.

The luggage of claim 3, wherein the first lid portion and the second lid portion are flexibly connected at a same side portion of corresponding first or second compartment, so as to open at a same other side portion of corresponding first or second compartment.

The first lid portion and the second lid portion may be flexibly connected at an opposite side portion of corresponding first or second compartment, so as to open at an opposite other side portion of corresponding first or second compartment.

The bottom portion of the first compartment, the bottom portion of the second compartment, and the bottom wall portion of the central compartment may be integrated into one body forming a bottom plate.

The luggage may further comprise four sidebounds, each of which being disposed at a lower corner portion between the side portions or the side wall portions and the bottom plate.

The four sidebounds may be formed monolithically.

Alternatively, the four sidebounds may be formed monolithically with the bottom plate.

The luggage may further comprise two or four casters installed at a bottom surface of the bottom plate.

The luggage may further comprise a center divider blocking a middle portion of the central compartment.

The first compartment may be connected to the central compartment through a hinge along one side and through a first fastening opener along the remaining perimeter, and the second compartment may be connected to the central compartment through a hinge along one side and through a second fastening opener along the remaining perimeter.

Each of the first or second fastening opener may comprise a zipper, and wherein the hinge comprises flexible connection or another zipper.

The luggage may further comprise a first divider provided so as to blocking the first opening portion and an access opening with a fastening opener provided through the first divider.

The luggage may further comprise a second divider provided so as to blocking the second opening portion and an access opening with a fastening opener provided through the second divider.

Each of the first lid portion and the second lid portion may comprise a soft plate portion.

Each of the first lid portion and the second lid portion may comprise a hard plate portion.

Each of the two vertical leg portions of the trolly handle may be fixed to the corresponding side wall portion of the central compartment through metal rivets.

The luggage may further comprise a housing structure embedded in the central compartment.

Each of the trolly handle may be embedded in or protruding on the corresponding side wall portion of the central compartment relative to a general surface of the the corresponding side wall portion of the central compartment.

The advantages of the present invention are: (1) the luggage according to the invention is strong in structure; (2) the luggage according to the invention can provide more convenient separate storing spaces, which can be used for different users; (3) the luggage according to the present invention provides a central compartment embedded in the middle of the luggage, which can be accessed from both sides; and (4) the luggage according to the present invention can be maneuvered in both directions due to its inventive positions and structures of the trolly handles.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 9 is a front view showing a luggage having an embedded trolly handle according to an embodiment of the invention;

FIG. 10 is a side view showing the luggage of FIG. 9;

FIG. 11 is a top plan view showing a first opening way of the luggage of FIG. 9;

FIG. 12 is a top plan view showing a second opening way of the luggage of FIG. 9;

FIGS. 17 through 22 are views of a luggage with hard sides, embedded trolly handle, and wide frame according to an embodiment of the invention;

FIGS. 23 through 28 are views of a luggage with hard sides, outside trolly handle, and wide frame according to an embodiment of the invention;

DETAILED DESCRIPTION EMBODIMENTS OF THE INVENTION

Figure 1:
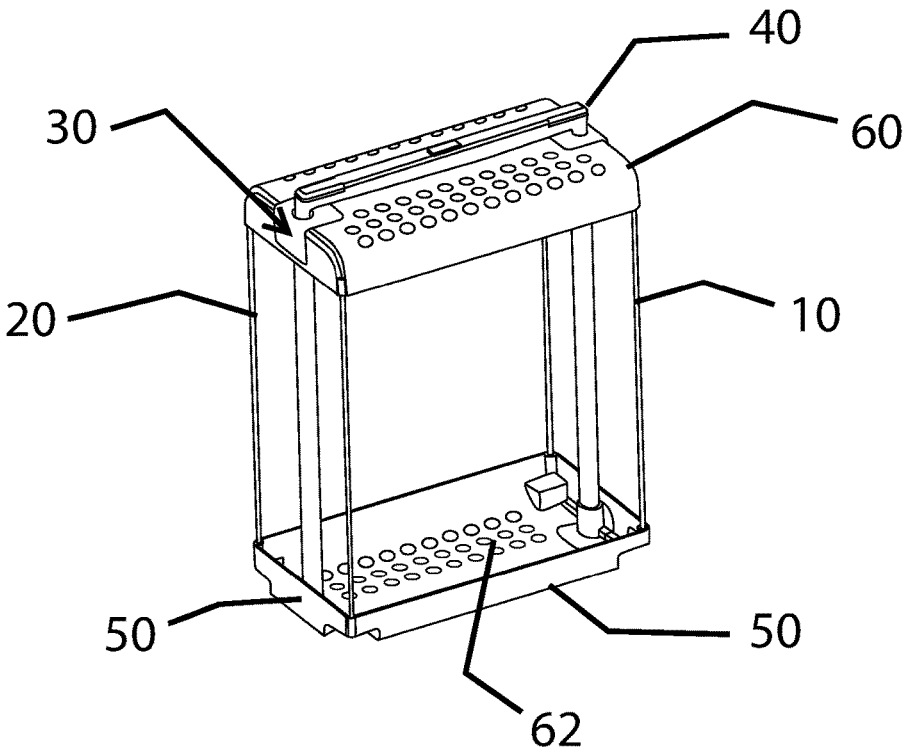
FIG. 1 is a perspective view showing a luggage having an outside trolly handle with sidebounds according to an embodiment of the invention.
Figure 2:
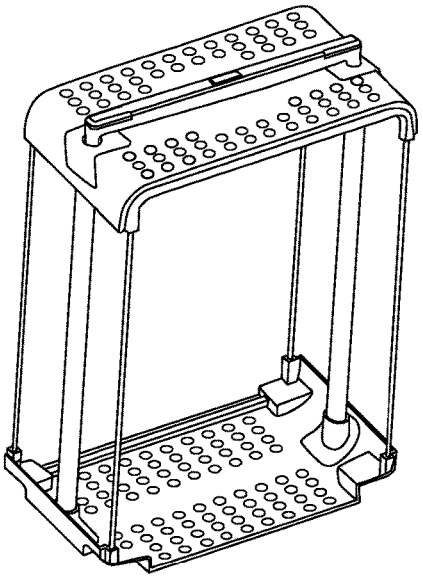
FIG. 2 is a perspective view showing a luggage having an outside trolly handle without sidebounds according to an embodiment of the invention.
Figure 3:
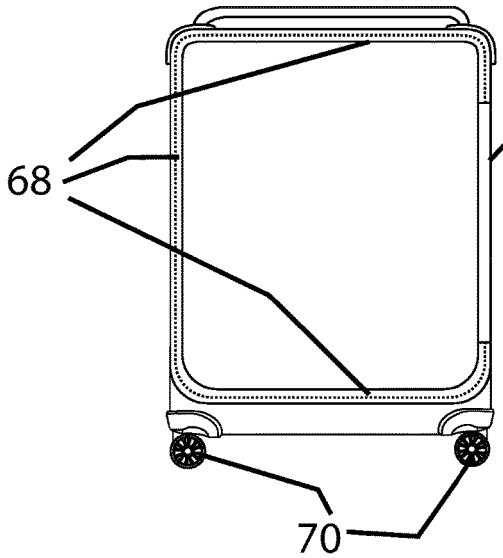
FIG. 3 is a front view showing a luggage having an outside trolly handle according to an embodiment of the invention.
Figure 4:
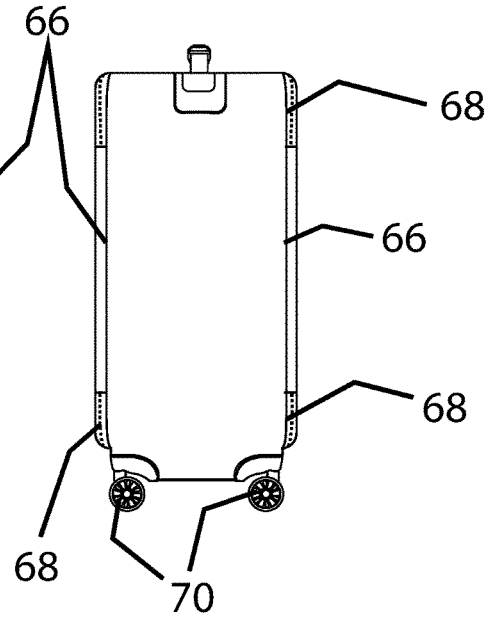
FIG. 4 is a side view showing the luggage of FIG. 3.

Referring to the figures, the embodiments of the invention are described in detail.

FIGS. 1 through 30 show luggages according to embodiments of the present invention.

An aspect of the invention provides a luggage, which comprises a first compartment 10, a second compartment 20, a central compartment 30, and a trolly handle 40 as shown in the figures. However, the figures show examples of the shape and size of the luggages according to the embodiments of the invention, not limiting the invention.

Figure 30:
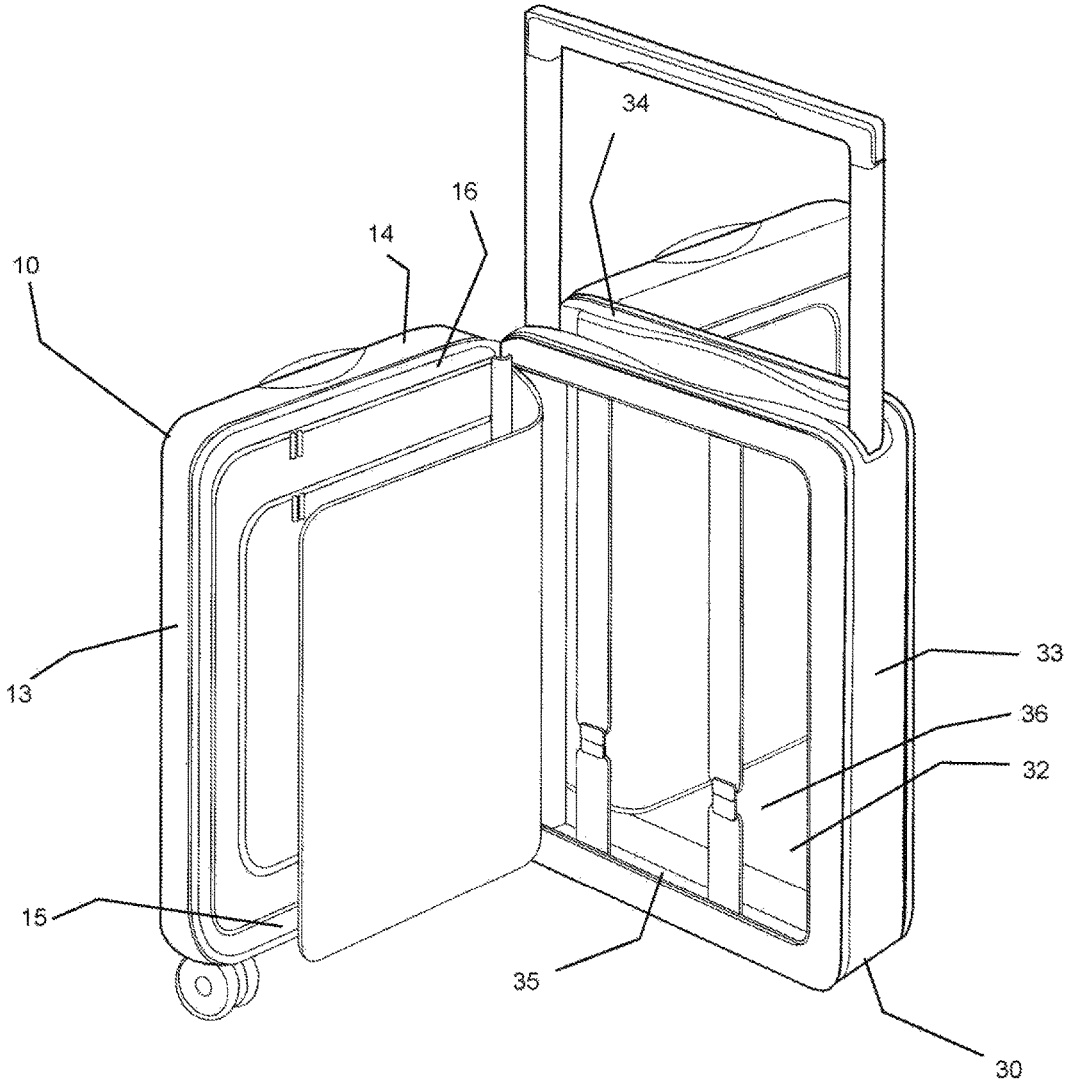
FIG. 30 is a perspective view showing a luggage with a first and second compartments opened according to an embodiment of the invention.

The first compartment 10 comprises a first lid portion 11 provided on an outer opening portion 12, two side portions 13, a top portion 14, a bottom portion 15, and an inner opening portion 16 defined by inner edges of the two side portions 13, the top portion 14, and the bottom portion 15 as shown in FIG. 30.

Figure 29:
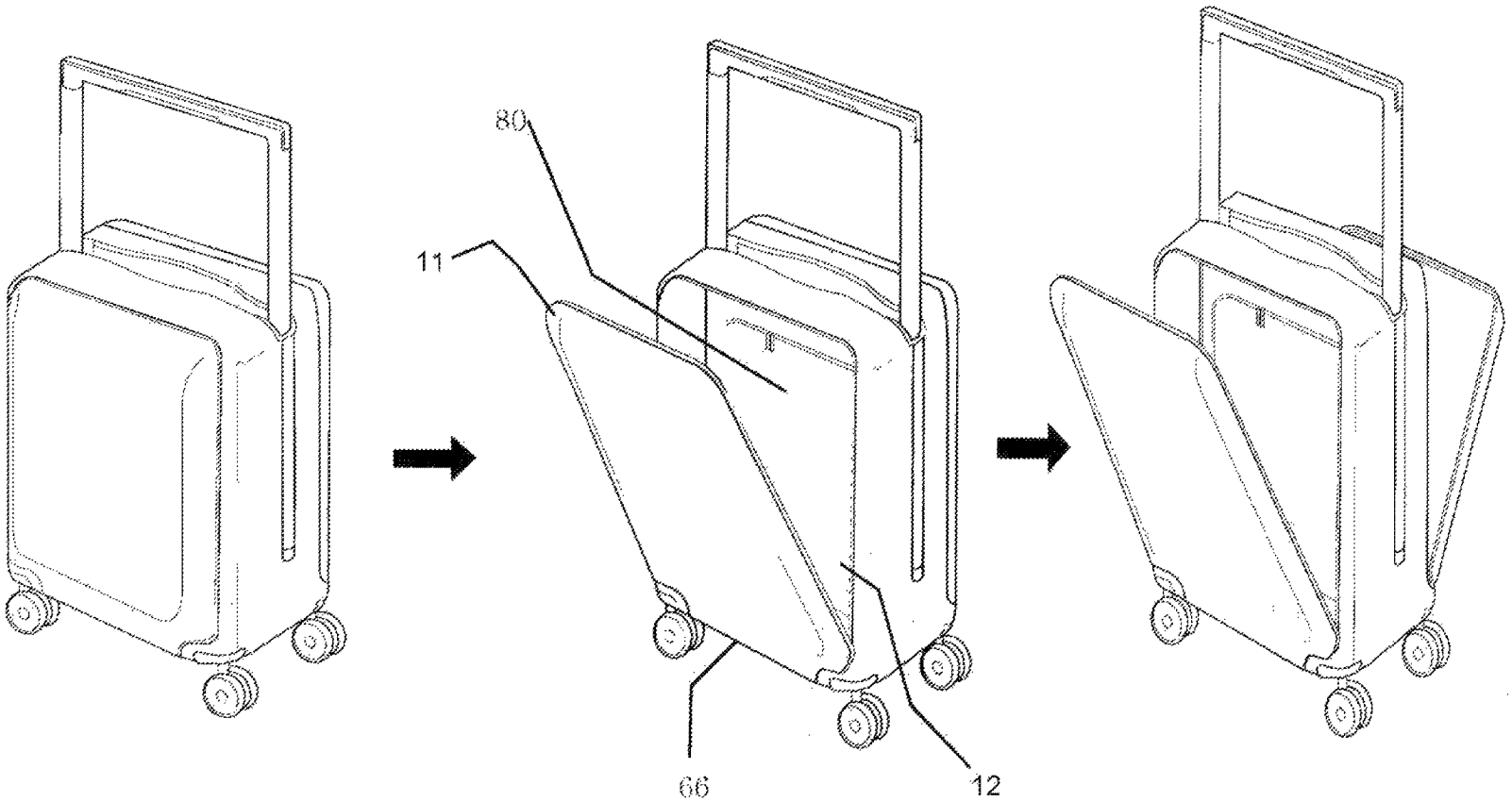
FIG. 29 is perspective views showing how to open compartments of a luggage according to an embodiment of the invention.

The second compartment 20 comprises a second lid portion 21 provided on an outer opening portion 22, two side portions 23, a top portion 24, a bottom portion 25, and an inner opening portion 26 defined by inner edges of the two side portions 23, the top portion 24, and the bottom portion 25 as shown in FIG. 29 and FIG. 30, with the corresponding reference numerals replaced.

The central compartment 30 is provided between the inner opening portions 16, 26 of the first compartment 10 and the second compartment 20 and has two side wall portions 33, a top wall portion 34, a bottom wall portion 35, and first and second opening portions 32, 36 as shown in FIG. 30.

Figure 5:
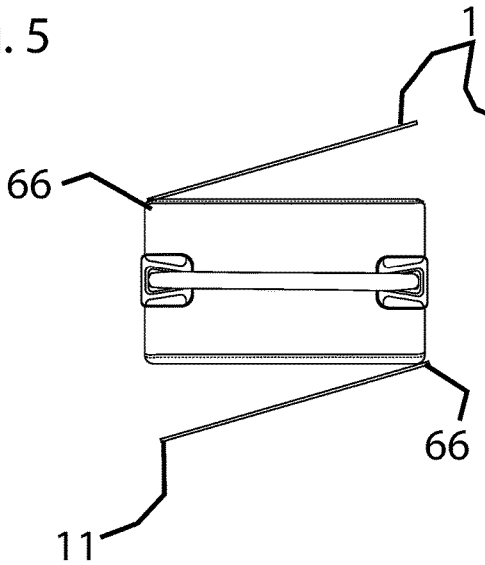
FIG. 5 is a top plan view showing a first opening way of the luggage of FIG. 3.
Figure 6:
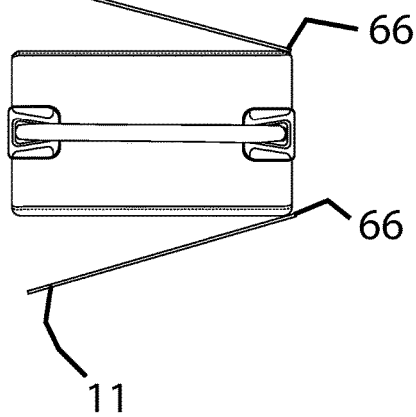
FIG. 6 is a top plan view showing a second opening way of the luggage of FIG. 3.

Even though FIG. 30 shows a luggage having a first compartment accessed through the border between the first and central compartments, the first or second compartments can be accessed through a first lid portion 11 as shown in FIG. 5 or 6. The positions for access (from the front or rear or from the center) can be switched against other properties such as hard or soft cover and the like.

The trolly handle 40 comprises two vertical leg portions 42 and a handle portion 44 connected to the two vertical leg portions 42 substantially perpendicular to each of the two vertical leg portions 42.

Each of the two vertical leg portions 42 of the trolly handle 40 is embedded in or protruding on a corresponding side wall portion 33 of the central compartment 30, so that the luggage is configured to be maneuverable in first and second directions toward the first and second compartments 10, 20, respectively.

The handle portion 44 of the trolly handle 40 may be connected to each of the two vertical leg portions 42 through telescopic structure provided therethrough.

The top portion 14 of the first compartment 10, the top portion 24 of the second compartment 20, and the top wall portion 34 of the central compartment 30 may be integrated into one body forming a top plate 60 as shown in FIGS. 1, 2, 7, and 8.

The first lid portion 11 and the second lid portion 21 are flexibly connected at a same side portion of corresponding first or second compartment 10, 20, so as to open at a same other side portion of corresponding first or second compartment 10, 20 as shown in FIGS. 6 and 12.

The first lid portion 11 and the second lid portion 21 may be flexibly connected at an opposite side portion of corresponding first or second compartment 10, 20, so as to open at an opposite other side portion of corresponding first or second compartment 10, 20 as shown in FIGS. 5 and 11.

The bottom portion 15 of the first compartment 10, the bottom portion 25 of the second compartment 20, and the bottom wall portion 35 of the central compartment 30 may be integrated into one body forming a bottom plate 62 as shown in FIGS. 1, 2, 7, and 8.

Figure 7:
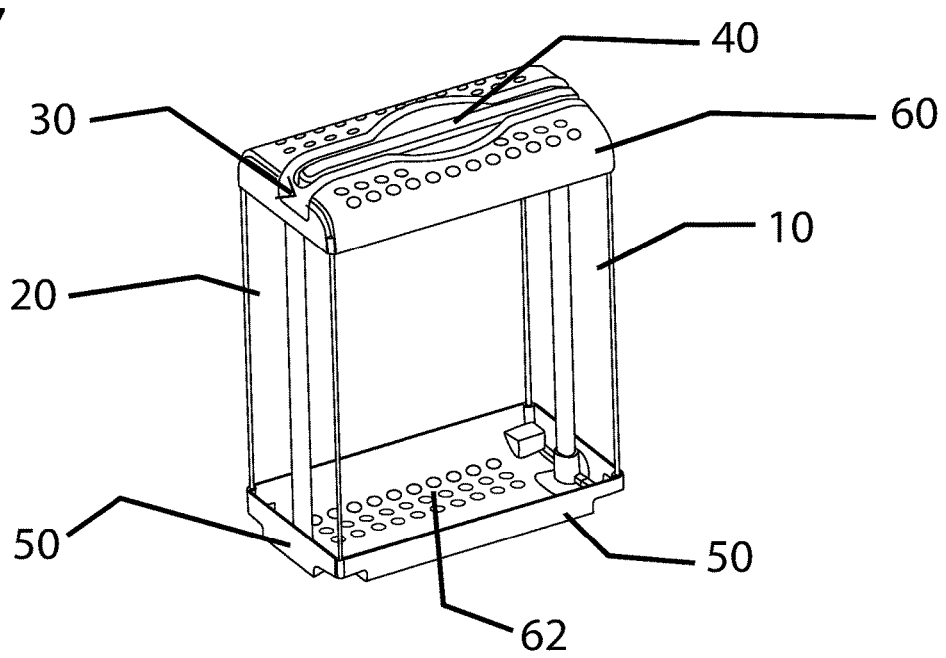
FIG. 7 is a perspective view showing a luggage having an embedded trolly handle with sidebounds according to an embodiment of the invention.
Figure 8:
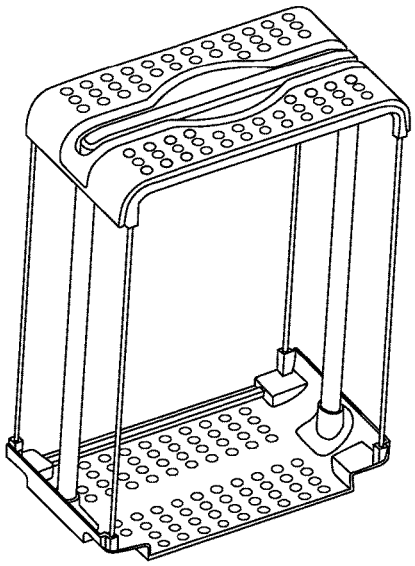
FIG. 8 is a perspective view showing a luggage having an embedded trolly handle without sidebounds according to an embodiment of the invention.
Figure 13:
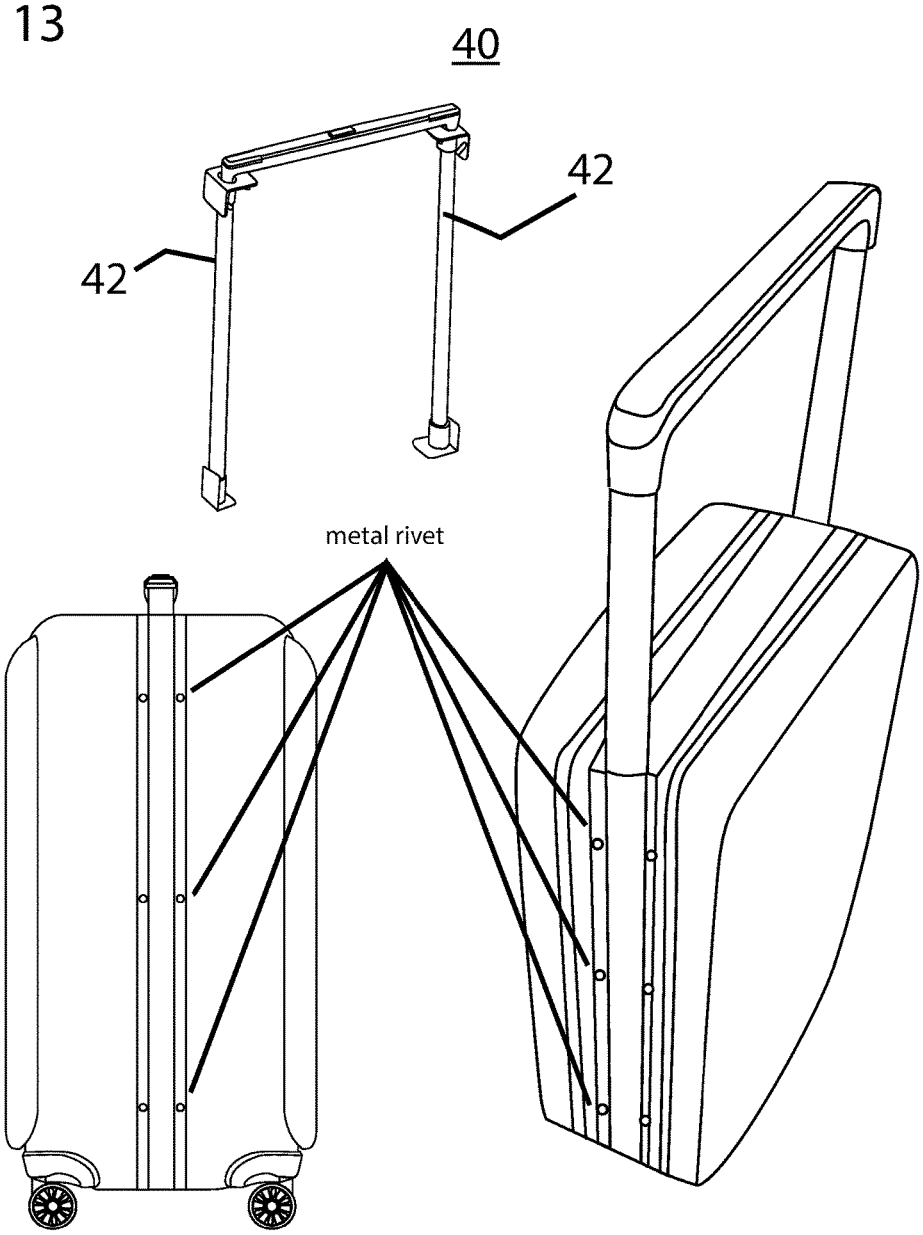
FIG. 13 is a perspective view showing an outside trolly handle of a luggage, a side view showing a luggage with the trolly handle, and a perspective view of the luggage according to an embodiment of the invention.
Figure 14:
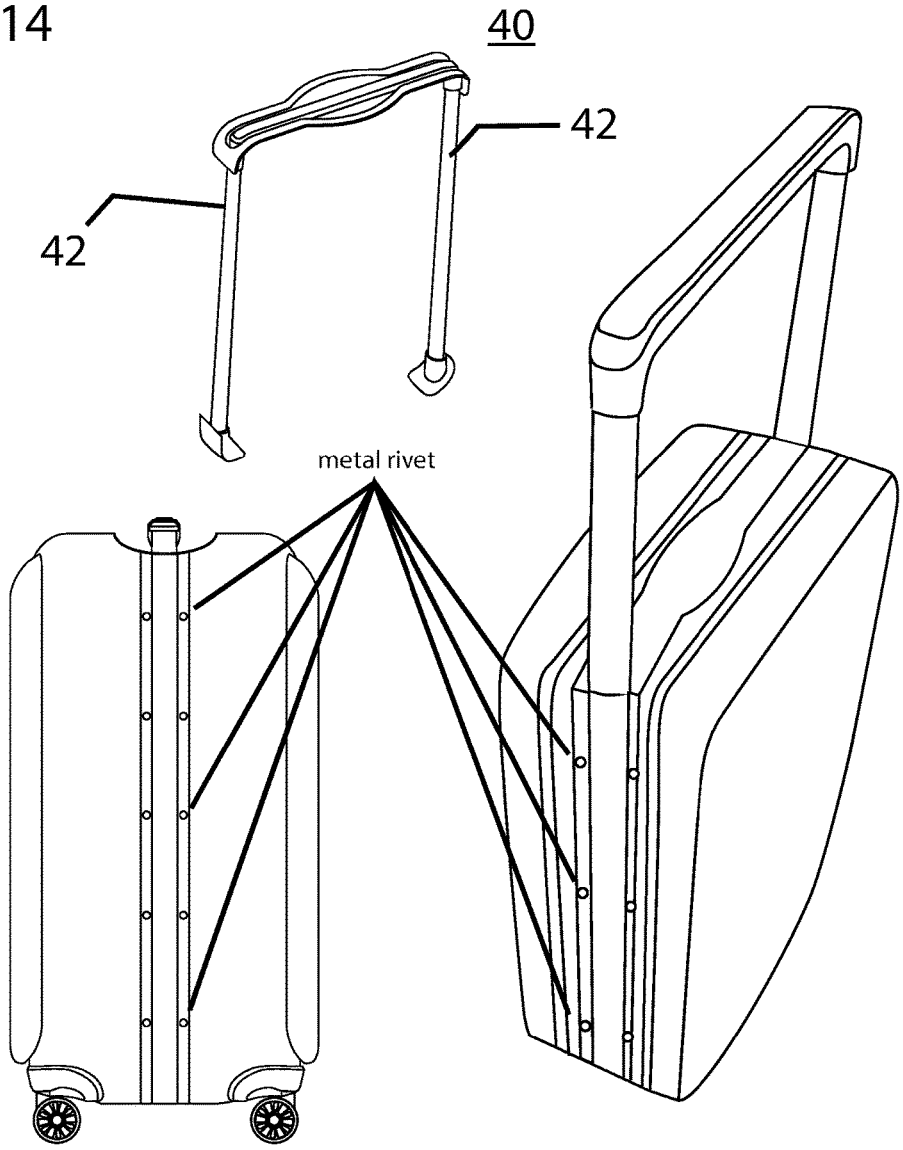
FIG. 14 is a perspective view showing an embedded trolly handle of a luggage, a side view showing a luggage with the trolly handle, and a perspective view of the luggage according to an embodiment of the invention.
Figure 15:
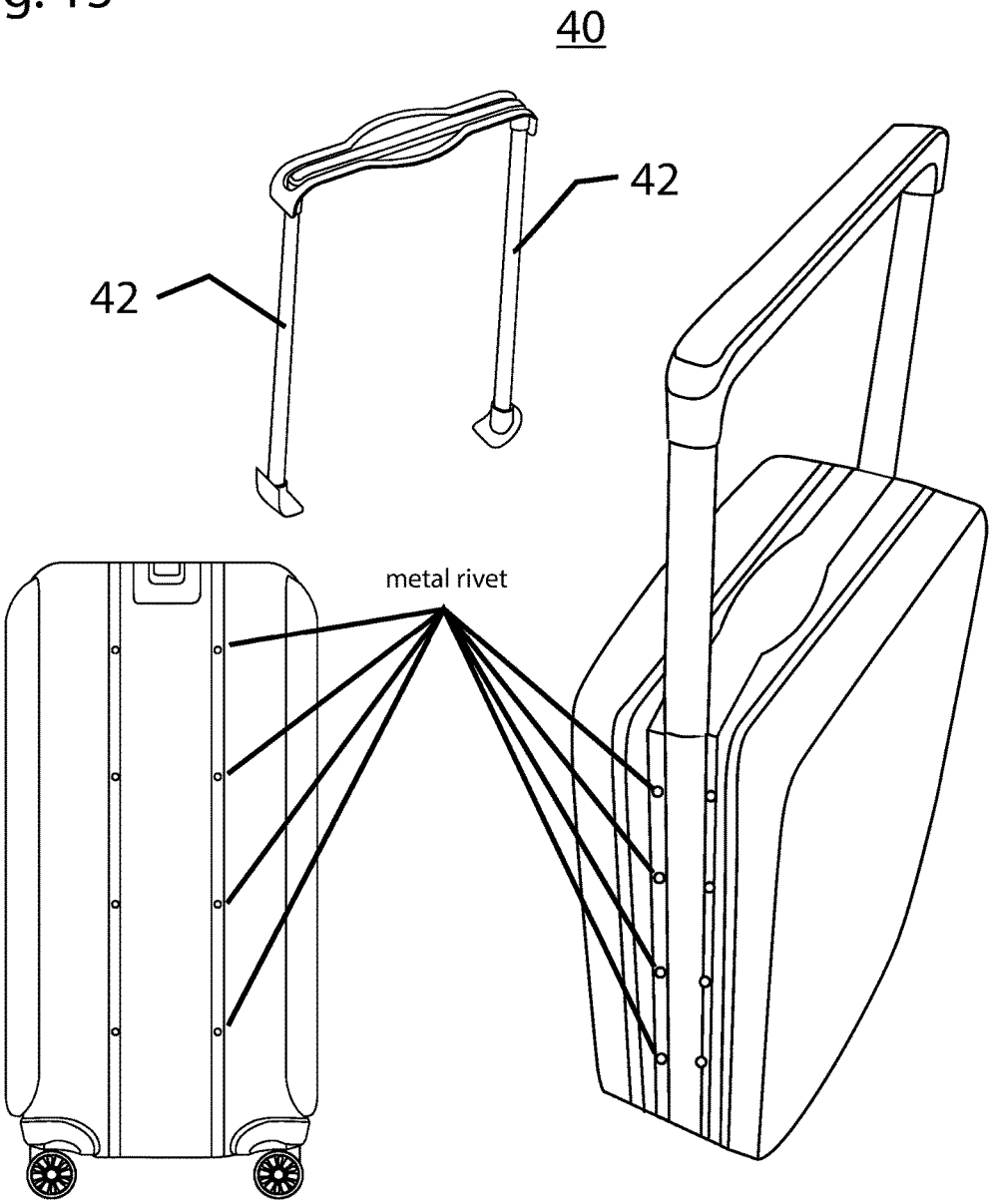
FIG. 15 is a perspective view showing an embedded trolly handle of a luggage with a wide frame, a side view showing a luggage with the trolly handle, and a perspective view of the luggage according to an embodiment of the invention.
Figure 16:
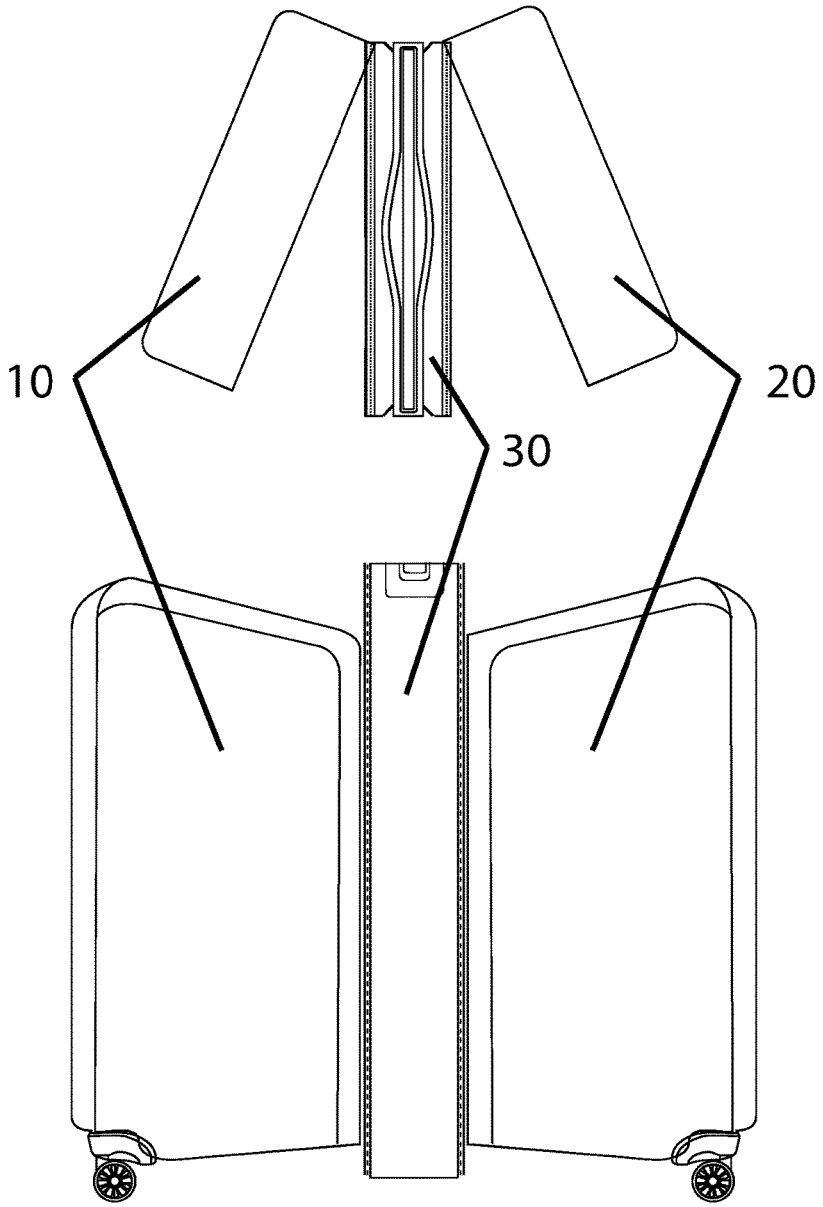
FIG. 16 is a top view and a side view showing the luggage of FIG. 5 according to an embodiment of the invention.
Figure 27:
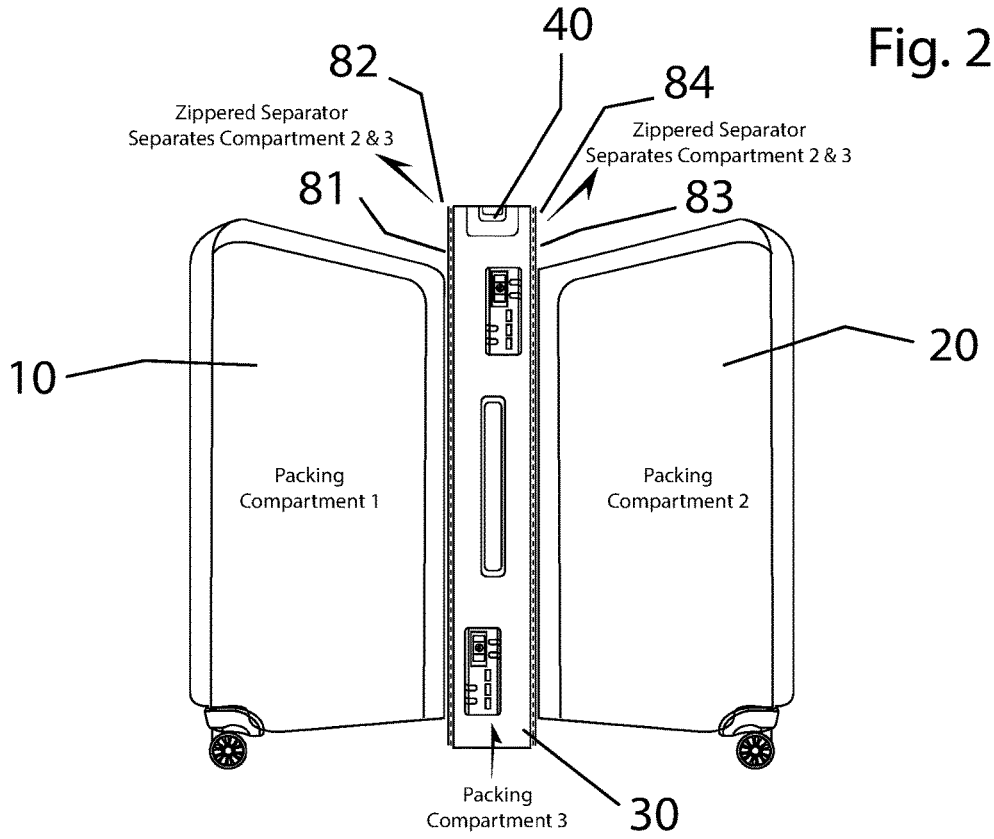
Figure 28:
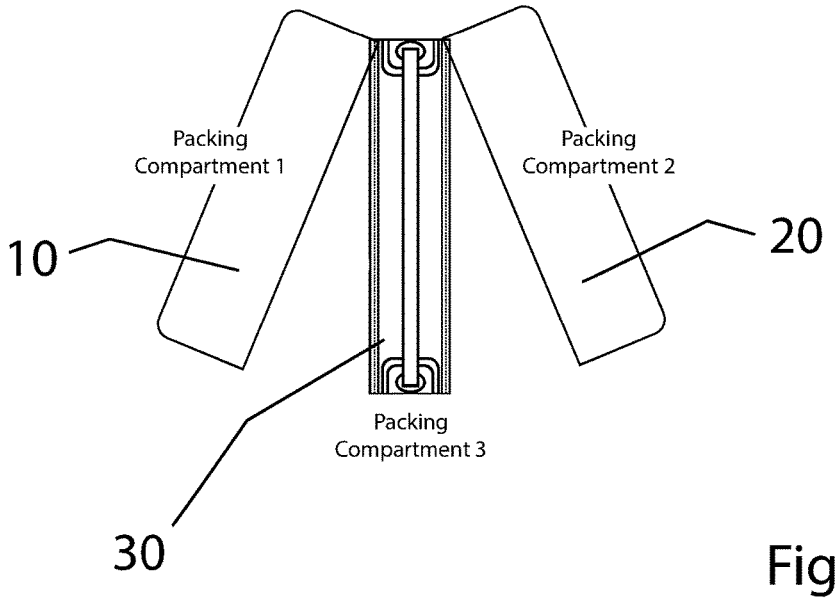

The luggage may further comprise four sidebounds 50, each of which being disposed at a lower corner portion between the side portions or the side wall portions and the bottom plate as shown in FIGS. 1 and 7. In certain embodiments of the invention, the same kind of sidebounds can be applied along the top portions partially or in all sides or corners as shown in FIGS. 1 and 7.

The four sidebounds 50 may be formed monolithically. In certain embodiments of the invention, alternatively, the four sidebounds 50 may be formed monolithically with the bottom plate 62.

The luggage may further comprise two or four casters 70 installed at a bottom surface of the bottom plate 62 as shown in FIGS. 3, 4, 9, and 10.

The luggage may further comprise a center divider 80 blocking a middle portion of the central compartment 30 as shown in FIG. 29. In the illustrated embodiment, the central compartment 30 has no independent storing space, but just provides a place to where the trolly handle 40 and the center divider 80 are positioned and installed. However, as will be shown below, the central compartment 30 may provide an independent storing space. In such a case, the center divider 80 become meaningless, and instead one or two accessing lid structures from one or both of the first and second compartments 10, 20 may be provided.

The first compartment 10 may be connected to the central compartment 30 through a hinge 66 along one side and through a first fastening opener 68 along the remaining perimeter, and likewise the second compartment 20 may be connected to the central compartment 30 through another hinge along one side and through a second fastening opener 68 along the remaining perimeter as shown in FIGS. 3-6, 9-12, and 29.

Each of the first or second fastening opener 68 may comprise a zipper, and wherein the hinge 66 comprises flexible connection or another zipper. Alternatively, the first or second fastening opener 68 may comprise a conventional locker and key system as shown in FIGS. 18 and 24.

The luggage may further comprise a first divider 82 provided so as to blocking the first opening portion and an access opening with a fastening opener 81 provided through the first divider 82.

The luggage may further comprise a second divider 84 provided so as to blocking the second opening portion and an access opening with a fastening opener 83 provided through the second divider 84.

Each of the first lid portion 11 and the second lid portion 21 may comprise a soft plate portion.

Each of the first lid portion 11 and the second lid portion 21 may comprise a hard plate portion.

Each of the two vertical leg portions 42 of the trolly handle 40 may be fixed to the corresponding side wall portion 33 of the central compartment 30 through metal rivets or other equivalent components.

The luggage may further comprise a housing structure embedded in the central compartment 30.

Each of the trolly handle 40 may be embedded in or protruding on the corresponding side wall portion 33 of the central compartment 30 relative to a general surface of the the corresponding side wall portion 33 of the central compartment 30.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A luggage comprising:

a first compartment comprising a first lid portion provided on an outer opening portion, two side portions, a top portion, a bottom portion, and an inner opening portion defined by inner edges of the two side portions, the top portion, and the bottom portion;

a second compartment comprising a second lid portion provided on an outer opening portion, two side portions, a top portion, a bottom portion, and an inner opening portion defined by inner edges of the two side portions, the top portion, and the bottom portion;

a central compartment provided between the inner opening portions of the first compartment and the second compartment and comprising two side wall portions, a top wall portion, a bottom wall portion, and first and second opening portions;

a first divider provided so as to blocking the first opening portion and an access opening with a fastening opener provided through the first divider; and a trolley handle comprising two vertical leg portions and a handle portion connected to the two vertical leg portions, wherein the first lid portion and the second lid portion are directly attached to a vertical side edge wall that is parallel to the vertical leg portions of the trolley handle.

2. The luggage of claim 1, further comprising a second divider provided so as to blocking the second opening portion and an access opening with a fastening opener provided through the second divider.

3. The luggage of claim 1, wherein each of the first lid portion and the second lid portion comprises a soft plate portion or a hard plate portion.

4. The luggage of claim 1, wherein the handle portion of the trolley handle is connected to the vertical leg portion through a telescopic structure provided therethrough.

5. The luggage of claim 1, wherein the first lid portion and the second lid portion are directly attached to the same vertical side edge wall that is parallel to the vertical leg portions of the trolley handle.

6. The luggage of claim 1, wherein the first lid portion and the second lid portion are directly attached to the opposite vertical side edge walls that is parallel to the vertical leg portions of the trolley handle so as to open at an opposite other side portion of corresponding first or second compartment.

7. A luggage comprising:

a first compartment comprising a first lid portion provided on an outer opening portion, two side portions, a top portion, a bottom portion, and an inner opening portion defined by inner edges of the two side portions, the top portion, and the bottom portion;

a second compartment comprising a second lid portion provided on an outer opening portion, two side portions, a top portion, a bottom portion, and an inner opening portion defined by inner edges of the two side portions, the top portion, and the bottom portion;

a central compartment provided between the inner opening portions of the first compartment and the second compartment and comprising two side wall portions, a top wall portion, a bottom wall portion, and first and second opening portions;

a trolley handle comprising a vertical leg portion and a handle portion connected to the vertical leg portion, and wherein the first lid portion and the second lid portion are directly attached to a vertical side edge wall that is parallel to the vertical leg portions of the trolley handle; and wherein the two vertical leg portions of the trolley handle is embedded in or protruding on a side wall portion of the central compartment, wherein the bottom portion of the first compartment, the bottom portion of the second compartment, and the bottom wall portion of the central compartment are integrated into one body forming a bottom plate, and the luggage further comprising four sidebounds, each of which being disposed at a lower corner portion between the side portions or the side wall portions and the bottom plate, wherein the four sidebounds are formed monolithically with the bottom plate.

8. The luggage of claim 7, wherein the top portion of the first compartment, the top portion of the second compartment, and the top wall portion of the central compartment are integrated into one body, and one or more casters installed at a bottom surface of the bottom plate.

9. The luggage of claim 7, further comprising a center divider blocking a middle portion of the central compartment.

10. The luggage of claim 7, further comprising a first divider provided so as to blocking the first opening portion and an access opening with a fastening opener provided through the first divider; and a second divider provided so as to blocking the second opening portion and an access opening with a fastening opener provided through the second divider.

11. The luggage of claim 7, wherein each of the first lid portion and the second lid portion comprises a soft plate portion or a hard plate portion.

12. The luggage of claim 7, wherein each of the first lid portion and the second lid portion comprises a soft plate portion or a hard plate portion.

13. A luggage comprising:

a first compartment comprising a first lid portion provided on an outer opening portion, two side portions, a top portion, a bottom portion, and an inner opening portion defined by inner edges of the two side portions, the top portion, and the bottom portion;

a second compartment comprising a second lid portion provided on an outer opening portion, two side portions, a top portion, a bottom portion, and an inner opening portion defined by inner edges of the two side portions, the top portion, and the bottom portion;

a central compartment provided between the inner opening portions of the first compartment and the second compartment and comprising two side wall portions, a top wall portion, a bottom wall portion, and first and second opening portions; and a trolley handle comprising a first vertical leg portion and a handle portion connected to the vertical leg portion, and wherein the first lid portion and the second lid portion are directly attached to the bottom wall portion of the central compartment substantially perpendicular to a vertical leg portion attached to the handle.

14. The luggage of claim 13, further comprising a second vertical leg portion substantially parallel to the first leg portion connected to the handle portion.

15. The luggage of claim 13, wherein the handle portion of the trolley handle is connected to the vertical leg portion through a telescopic structure provided therethrough.

16. The luggage of claim 13, wherein the first lid portion and the second lid portion are directly attached to the same vertical side edge wall that is parallel to the vertical leg portions of the trolley handle.

17. The luggage of claim 13, wherein the first lid portion and the second lid portion are directly attached to the opposite vertical side edge walls that is parallel to the vertical leg portions of the trolley handle so as to open at an opposite other side portion of corresponding first or second compartment.

18. The luggage of claim 13, further comprising a first divider provided so as to blocking the first opening portion and an access opening with a fastening opener provided through the first divider; and a second divider provided so as to blocking the second opening portion and an access opening with a fastening opener provided through the second divider.

* * * * *